United States Patent [19]

Marett, Jr.

[11] 4,305,055

[45] Dec. 8, 1981

[54] TELEVISION DISPLAY SYSTEM INCORPORATING A COMA CORRECTED DEFLECTION YOKE

[75] Inventor: Thomas A. Marett, Jr., Lancaster, Pa.

[73] Assignee: RCA Corporation, New York, N.Y.

[21] Appl. No.: 162,594

[22] Filed: Jun. 24, 1980

[51] Int. Cl.[3] ..... H01F 3/12

[52] U.S. Cl. ..... 335/211; 335/210

[58] Field of Search ..... 335/210, 211, 212, 213, 335/214

[56] References Cited

U.S. PATENT DOCUMENTS 3,899,761 8/1975 Yamauchi ..... 335/211

4,237,437 12/1980 Vink et al. ..... 335/211

FOREIGN PATENT DOCUMENTS 2010005 6/1979 United Kingdom .

*Primary Examiner*—Harold Broome

*Attorney, Agent, or Firm*—Eugene M. Whitacre; Paul J. Rasmussen; Scott J. Stevens

[57] ABSTRACT

A television display system comprises a kinescope, deflection yoke and magnetic field influencing apparatus. The field influencing apparatus comprises a pair of magnetically permeable members disposed on either side of the yoke. One end of each member is positioned within the external field of the toroidally-wound vertical deflection coil. The other end of each member is divided into an upper and lower field-forming arm. The upper arms of each member are disposed adjacent each other such that a gap is formed between them in the vicinity of the entrance end of the yoke. The lower arms are similarly disposed. The gaps are vertically aligned with the longitudinal axis of the kinescope. The width of the gaps is less than the spacing between the outer electron beams in the vicinity of the entrance end of the yoke. Flux from the external field is channeled into each permeable member to the ends of the field-forming arms. A field is produced between the upper arms of each member and the lower arms of each member. This field has a pincushion-shaped configuration within the tube neck for correcting vertical coma errors without undesirably interacting with the outer electron beams.

5 Claims, 2 Drawing Figures

TELEVISION DISPLAY SYSTEM INCORPORATING A COMA CORRECTED DEFLECTION YOKE

Figure 1:
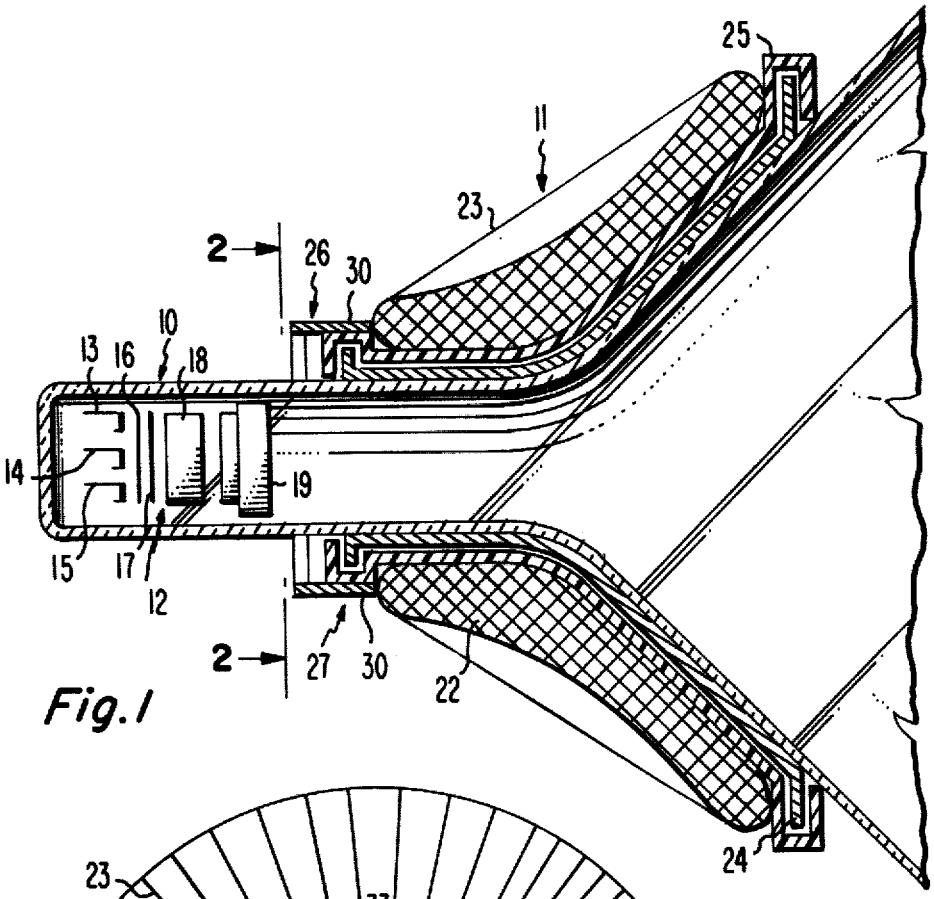

This invention relates generally to television display systems employing self-converging deflection yokes, and in particular to apparatus for correcting vertical coma distortion in such yokes, and to display systems employing such apparatus.

It is known that deflection yokes for kinescopes having horizontal in-line electron beams may be constructed which substantially converge the three electron beams at all points on the kinescope display screen without the need for dynamic convergence circuitry. This is accomplished by configuring the horizontal deflection coils to produce a net negative isotropic astigmatism and the vertical coils to produce a net positive isotropic astigmatism. Negative isotropic astigmatism is produced by a deflection field which is predominantly pincushion shaped when viewed in cross section along the axis of electron beam propagation; i.e., the longitudinal axis of the kinescope. Positive isotropic astigmatism is produced by a deflection field which is predominantly barrel-shaped. A mathematical analysis of the deflection fields using third order aberration theory can be used to determine the deflection field nonuniformity or $H_2$ function for the horizontal and vertical deflection coils. It is this analysis that reveals the nature of the isotropic astigmatism necessary to converge the three electron beams.

Third order aberration theory can also be used to determine the field nonuniformity function necessary to correct coma errors (sized differences between the center-beam raster and the rasters of the outer beams) and raster distortions (e.g. top/bottom pincushion distortion and side pincushion distortion) that can occur with self-converging yokes. It can be shown that coma is most sensitive to correction by a pincushion shaped field at the entrance region of the yoke, while top/bottom and side pincushion distortion is sensitive to correction by a pincushion shaped field in the exit region of the yoke. Third order aberration analysis such as that just described can be found in U.S. Patent Application Ser. No. 070,311, filed Aug. 27, 1979.

In design of a yoke for substantial self-convergence, the horizontal deflection coils, as previously stated, are configured to provide a net negative isotropic astigmatism, such as is provided by a pincushion shaped deflection field. This field shape requirement for self-convergence is consistent with that needed to correct coma and top and bottom pincushion distortion, as previously described. It is therefore relatively easy to manufacture horizontal coils that are essentially coma and pincushion-free. The vertical deflection coils, on the oher hand, are required to produce a net positive isotropic astigmatism for convergence, such as is provided by a barrel-shaped field. This barrel-shaped field is inconsistent with the pincushion-shaped field needed for coma and side pincushion correction. Winding the vertical coils with the necessary pincushion-shaped fields needed to provide coma and pincushion correction while still maintaining an overall net barrel-shaped field for convergence of the three electron beams results in requirements for the deflection field nonuniformity function that undesirably increase the sensitivity of convergence to transverse motion of the yoke on the tube neck.

An apparatus for correcting vertical comma errors without the aforesaid increase in convergence sensitivity is disclosed in a copending application of W. H. Barkow and J. Gross, Ser. No. 149,681, filed May 14, 1980 and is also assigned to the present assignee. The Barkow et al application discloses a pair of external field formers disposed so as to collect stray flux from the vertical deflection coils and channel that flux to the rear of the yoke, where a pincushion-shaped field is formed between the field formers to aid in coma correction. This pincushin field, increases deflection of the center beam, therefore enlarging the center beam raster, and tending to correct coma errors of the type where the center beam raster is reduced in height with respect to the outer beam rasters. This supplemental field may also undesirably interact with the outer two beams which may cause misconvergence of the outer beams at the ends of the vertical axis of the raster.

The present invention provides a supplemental coma-correcting deflection field which does not substantially interact with the outer electron beams, thereby providing the coma correction of the apparatus in the aforementioned application without introducing additional beam misconvergence.

In an illustrative embodiment of the present invention a magnetic field influencing means for use with a television display system comprises a pair of magnetically permeable members disposed near the rear of a deflection yoke mounted on a kinescope neck. The kinescope incorporates means for producing a set of three in-line electron beams. The yoke comprises means for producing an internal deflection field and an external field. One end of the permeable members is disposed adjacent to the core of the yoke within the external field generated by the deflection yoke. The other end of each permeable member is bifurcated to form an upper and lower arm which terminates adjacent to the tube neck in the vicinity of the entrance end of the deflection yoke. The ends of the upper arms of each permeable member and the lower arms of each member form upper and lower gaps therebetween. The gaps are positioned substantially vertically aligned with the longitudinal axis of the kinescope. The width of each gap is less than the distance between the outer two beams of the three electron beams in that region. A portion of the external field is channeled to the ends of the field formers where a pincushion field is formed within the kinescope neck. This pincushion field corrects coma errors substantially without interacting with the outer two electron beams.

Figure 2:
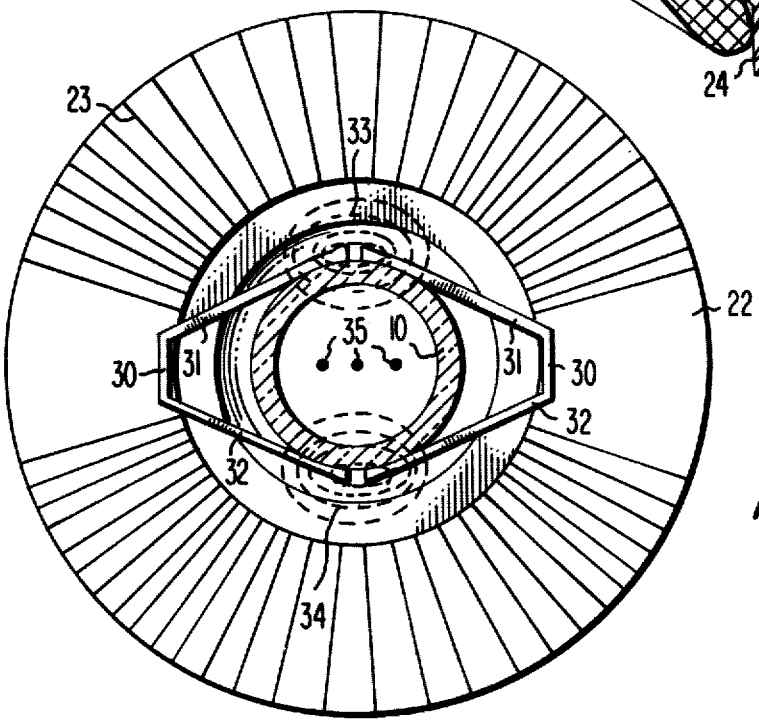

In the accompanying drawing, FIG. 1 is a cross sectional top view of a television display system in accordance with the present invention; and FIG. 2 is a cross sectional view taken along line 2—2 of the television display system of FIG. 1.

Referring to FIG. 1, there is shown a television display system which incorporates means for correcting vertical coma without adversely affecting convergence of the three electron beams. This display system comprises a kinescope 10 and a deflection yoke 11. The deflection yoke 11 is mounted on the kinescope 10 in the region where the neck and funnel of the kinescope are joined. An electron gun assembly 12 comprising in-line cathodes 13, 14 and 15 and accellerating and focusing grids 16, 17, 18 and 19 is disposed within the neck of the kinescope 10.

Deflection yoke 11 comprises a magnetically permeable core 22, generally in the shape of a torus, about which is wound the vertical deflection coils 23. These toroidally-wound coils may have either a radial or non-radial winding configuration; that is, the plane of the windings may or may not pass through the longitudinal axis of the core. It is known that side-pincushion distortion correction may be achieved through the use of non-radial or biased vertical windings. Deflection yoke 11 also comprises saddle-wound horizontal deflection coils 24. Deflection coils 24 are configured with the proper nonuniform winding distribution to provide convergence of the electron beams free of horizontal coma and top and bottom pincushion distortion. This is easier to accomplish with the horizontal coils than with the vertical, since a pincushion-shaped field is needed for both convergence and for coma and top- and bottom-pincushion correction. An insulator 25 is disposed between the horizontal and vertical coils.

Deflection yoke 11 also incorporates magnetically permeable field formers 26 and 27. Field formers 26 and 27 each have one end which is disposed adjacent to permeable core 22. A flux-gathering portion 30 of field formers 26 and 27 extends from that end substantially parallel to the kinescope neck. Field formers 26 and 27 then angle sharply toward the kinescope neck, dividing to form an upper and lower arm 31 and 32 of each field former which extends above and below the kinescope neck as shown in FIG. 2. Corresponding arms 31 and 32 terminate in relatively close proximity to each other. The approximate locations of the electron beams 35 within the kinescope neck are also shown in FIG. 2.

The deflection field generated by the vertical deflection coils 23 is comprised of an internal field, which includes the main deflection field and also includes extrance and exit fringe fields which aid in deflection, and an external stray field, which does not contribute to deflection. The internal and external fields are bounded by a surface defined by the inside contour of the core 22 and imaginary extensions thereof from the front and rear of the yoke. The flux-gathering portion 30 of field formers 26 and 27 are disposed within the external stray field. The magnetically permeable nature of field formers 26 and 27 causes flux from the external field to be channeled into flux-gathering portions 30. This flux is carried to the ends of upper and lower arms 31 and 32. A substantially barrel-shaped field 33 and 34 is formed between corresponding arms 31 and 32 of field formers 26 and 27. The portion of each of fields 33 and 34 which falls within the tube neck, however, combines to form a pincusion-shaped field. The small gaps between corresponding upper arms 31 and lower arms 32 cause the field that is formed to be very localized in a manner affecting substantially only the center beam. A result of this will be to increase deflection of the center beam, thereby reducing vertical coma error. The highly localized nature of the coma-correcting field avoids convergence-degrading interaction with the outer two beams. Since the coma-correction is achieved by using external stray, otherwise useless flux, an increased vertical scan is realized without an increase in power consumption of the yoke.

As an operative example, a pair of permeable members have been shown to correct coma errors without introducing additional beam misconvergence by positioning the members so that the width of the upper arm and lower gaps is in the range of 3–5 millimeters. In the region of the supplemental coma-correcting field, the electron beams are spaced on the order of 5.6 millimeters apart and are subject to a vertical deflection of approximately 4.5 millimeters. The gaps themselves are located approximately 15 millimeters from the kinescope longitudinal axis.

What is claimed is:

1. In a television display system having a kinescope incorporating an electron beam assembly disposed within the neck of said kinescope for producing a set of three in-line electron beams, the centrally located one of said beams being produced in substantial alignment with the longitudinal axis of said kinescope, and a deflection yoke encircling the paths of said beams departing said electron gun assembly and comprising a deflection coil for producing an internal vertical deflection field and an external field, said deflection yoke deflecting said beams to form three substantially superimposed rasters; a magnetic field influencing apparatus comprising:

first and second magnetically permeable members, disposed on opposite sides of said yoke, each of said first and second members having a first end disposed within said external field and a second end disposed adjacent said kinescope neck in the vicinity of the entrance end of said yoke, each of said second ends of said first and second members being bifurcated to form upper and lower field-forming arms, the termination of said upper arm of said first member and the termination of said upper arm of said second member forming a first gap therebetween, the termination of said lower arm of said first member and the termination of said lower arm of said second member forming a second gap therebetween, each of said first and second gaps being vertically aligned with said longitudinal axis of said kinescope, the width of each of said first and second gaps being less than the distance between the outer beams of said electron beam set in the vicinity of the entrance end of said deflection yoke.

2. The arrangement defined in claim 1, wherein the width of each of said first and second gaps is in the range of 3–5 millimeters, and the spacing between adjacent beams of said set lies above said range.

3. The arrangement defined in claim 1, wherein said deflection coil is toroidally wound about a magnetically permeable core.

4. The arrangement defined in claim 3, wherein the configuration of said first and second members is such that a pincushion-shaped field is formed within said neck in the vicinity of the entrance end of said yoke, said pincushion-shaped field substantially affecting only the centrally located one of said electron beam set such that the horizontal lines of said central beam raster coincide with the horizontal lines of said outer-beam rasters.

5. A television display system comprising:

a kinescope, including a neck and an electron gun assembly disposed within said neck for producing a set of three in-line electron beams;

a deflection yoke encircling the paths of said beam set departing said electron gun assembly, said yoke comprising a deflection coil for producing an internal vertical deflection field and an external field, said deflection yoke deflecting said beams to form three substantially superimposed rasters;

a magnetic field influencing apparatus comprises first and second magnetically permeable members, disposed on opposite sides of said yoke, each of said first and second members having a first end disposed within said external field and a second end disposed adjacent said kinescope neck in the vicinity of the entrance end of said yoke, each of said second ends of said first and second members being bifurcated to form upper and lower field-forming arms, the termination of said upper arm of said first member and the termination of said upper arm of said second member forming a first gap therebetween, the termination of said lower arm of said first member and the termination of said lower arm of said second member forming a second gap therebetween, each of said first and second gaps being vertically aligned with said longitudinal axis of said kinescope, the width of each of said first and second gaps being less than the distance between the outer beams of said electron beam set in the vicinity of the entrance end of said deflection yoke.

* * * * *